US009041500B2

(12) United States Patent
Moiseev

(10) Patent No.: US 9,041,500 B2
(45) Date of Patent: May 26, 2015

(54) MAGNETIC CORE

(75) Inventor: Sergey Moiseev, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 0 days.

(21) Appl. No.: 13/487,381

(22) Filed: Jun. 4, 2012

(65) Prior Publication Data

US 2012/0306605 A1 Dec. 6, 2012

(30) Foreign Application Priority Data

Jun. 6, 2011 (JP) ..... 2011-126333

(51) Int. Cl.

| | |
|---|---|
| ***H01F 27/08*** | (2006.01) |
| ***H01F 27/10*** | (2006.01) |
| ***H01F 27/02*** | (2006.01) |
| ***H01F 27/06*** | (2006.01) |
| ***H01F 27/24*** | (2006.01) |
| ***H01F 17/04*** | (2006.01) |
| ***H01F 27/22*** | (2006.01) |

(52) U.S. Cl.

CPC ..... *H01F 17/04* (2013.01); *H01F 27/22* (2013.01)

(58) Field of Classification Search

CPC ..... H01F 27/22; H01F 27/085; H01F 27/025; H01F 27/12; H01F 37/00

USPC ..... 336/55, 56, 57, 58, 59, 60, 61, 131, 336/212, 221

See application file for complete search history.

(56) References Cited

U.S. PATENT DOCUMENTS

| | | | | |
|---|---|---|---|---|
| 5,656,983 | A * | 8/1997 | Ito et al. | 335/297 |
| 5,748,013 | A | 5/1998 | Beauclair et al. | |
| 6,014,071 | A * | 1/2000 | Onishi et al. | 336/170 |
| 6,639,499 | B2 * | 10/2003 | Okita et al. | 336/110 |
| 6,844,802 | B2 | 1/2005 | Drummond et al. | |
| 7,800,474 | B2 * | 9/2010 | Yabumi et al. | 336/110 |
| 2009/0045683 | A1 * | 2/2009 | Vermeulen et al. | 310/14 |
| 2012/0146759 | A1 * | 6/2012 | Shibuya et al. | 336/221 |
| 2012/0161911 | A1 | 6/2012 | Moiseev et al. | |
| 2012/0200382 | A1 * | 8/2012 | Hejny | 336/212 |
| 2012/0293290 | A1 * | 11/2012 | Kido et al. | 336/60 |
| 2012/0313740 | A1 * | 12/2012 | Inaba et al. | 336/61 |

FOREIGN PATENT DOCUMENTS

| | | |
|---|---|---|
| CN | 1441446 | 9/2003 |
| DE | 2124478 | 11/1972 |
| DE | 102006026466 | 12/2007 |

(Continued)

OTHER PUBLICATIONS

Japan Office action, mail date is Apr. 16, 2013.

(Continued)

*Primary Examiner* — Elvin G Enad
*Assistant Examiner* — Kazi Hossain
(74) *Attorney, Agent, or Firm* — Greenblum & Bernstein, P.L.C.

(57) ABSTRACT

A magnetic core includes a first core having a predetermined magnetic permeability and a second core formed of the same material as the first core. The second core forms a closed magnetic circuit together with the first core. The second core is configured to radiate heat through a heat radiating unit. At least one of the first core and the second core is configured to be wound with a coil. The magnetic core includes a third core that is arranged between the first core and the second core and has a lower magnetic permeability than the first core.

3 Claims, 2 Drawing Sheets

(56) References Cited

FOREIGN PATENT DOCUMENTS

| | | | |
|---|---|---|---|
| FR | 649498 | | 12/1928 |
| JP | 60-015908 | | 1/1985 |
| JP | 2-251107 | | 10/1990 |
| JP | 8-107021 | | 4/1996 |
| JP | 08-107021 | * | 4/1996 |
| JP | 2000-331841 | | 11/2000 |
| JP | 2001-102217 | | 4/2001 |
| JP | 2002-057039 | | 2/2002 |
| JP | 2002-057139 | | 2/2002 |
| JP | 2002-158117 | | 5/2002 |
| JP | 2008-041882 | | 2/2008 |
| JP | 2009-088251 | | 4/2009 |
| JP | WO 2011-027559 | * | 3/2011 |
| JP | WO 2011-065001 | * | 6/2011 |

OTHER PUBLICATIONS

Germany Office action, dated Apr. 23, 2014 along with an english translation thereof.

Chinese Official Action dated Nov. 17, 2014, along with an English-language translation thereof.

* cited by examiner

MAGNETIC CORE

BACKGROUND OF THE INVENTION

The present invention relates to a magnetic core.

Conventionally, a reactor, which is a type of induction device, has a pair of cores formed of ferrite with high magnetic permeability and a non-magnetic membrane formed of plastic with low magnetic permeability arranged between the cores to obtain desirable DC superposition characteristics. See, for example, Japanese Laid-open Patent Publication No. 2001-102217.

It is known that a change in the electric current flowing in a coil of an induction device causes heat generation in not only the coil but also cores. However, in the induction device described in the aforementioned document, plastic arranged between the cores, which exhibits a low thermal conductivity, suppresses heat transfer from one of the cores (a first core) to the other one of the cores (a second core). Accordingly, when a cooler is arranged in the first core to radiate heat from the first core, for example, the plastic prevents heat transfer from the second core. The heat is thus easily accumulated in the second core. This problem also occurs in a case in which an air gap is formed between the cores instead of arranging the plastic between the cores.

To solve the problem, the plastic or the air gap may be omitted so that the cores formed of ferrite are allowed to contact each other to facilitate heat transfer from one core to the other. However, in this configuration, improved DC superposition characteristics cannot be obtained.

SUMMARY OF THE INVENTION

Accordingly, it is an objective of the present invention to provide a magnetic core that ensures improved DC superposition characteristics and enhances heat radiation performance.

To achieve the foregoing and in accordance with a first aspect of the present invention, a magnetic core that includes a first core and a second core is provided. The first core has a predetermined magnetic permeability. The second core is formed of the same material as the first core and forms a closed magnetic circuit together with the first core. The second core is configured to radiate heat through a heat radiating unit. At least one of the first core and the second core is configured to be wound with a coil. The magnetic core further includes a third core arranged between the first core and the second core, the third core having a lower magnetic permeability than the first core.

According to a second aspect of the present invention, an induction device having the magnetic core of the first mode and a coil wound around the magnetic core is provided.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A magnetic core according to one embodiment of the present invention will now be described with reference to FIGS. 1A to 1C.

Figures 1A, 1B, 1C:
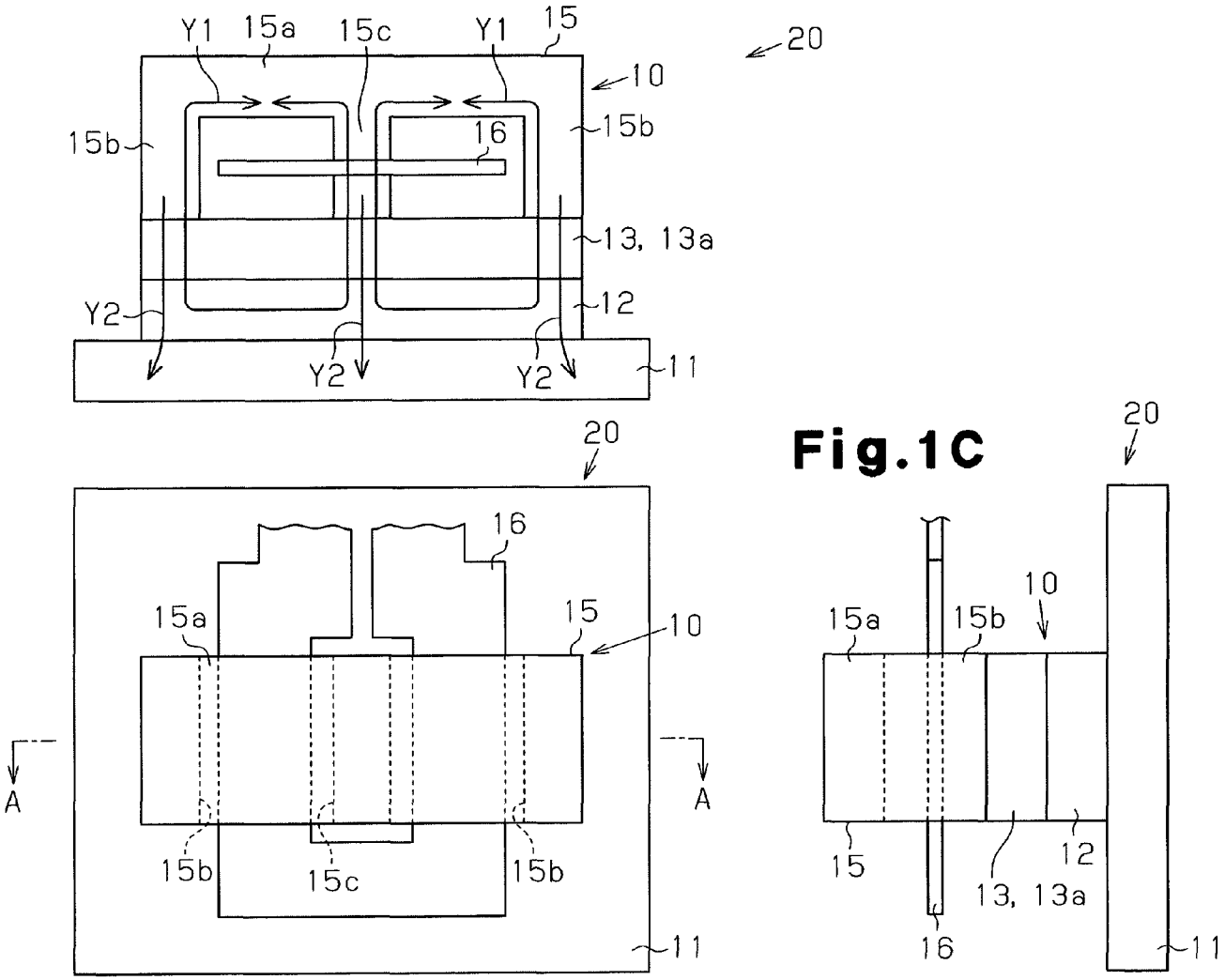
FIG. 1A is a front view schematically showing a magnetic core and a reactor according to one embodiment of the present invention.
FIG. 1B is a plan view schematically showing the magnetic core and the reactor illustrated in FIG. 1A.
FIG. 1C is a side view schematically showing the magnetic core and the reactor illustrated in FIG. 1A.

As illustrated in FIGS. 1A to 1C, an I-shaped core 12 serving as a second core, which is shaped like a flat elongated rectangular plate as viewed from above, is adhered to a heat radiation board 11 serving as a heat radiating unit (a heat radiator) formed of aluminum. Specifically, the I-shaped core 12 is fixed to the heat radiation board 11 and held in tight contact with the heat radiation board 11. The I-shaped core 12 is a ferrite core made of ferrite of, for example, a MnZn based material or a NiMn based material.

A dust core member 13*a* is adhered to the surface of the I-shaped core 12 opposite to the adhesion surface adhered to the heat radiation board 11. The dust core member 13*a* is shaped identically to the I-shaped core 12 as viewed from above. Also, the dust core member 13*a* is adhered to the I-shaped core 12, while being stacked with each other at coinciding positions as viewed from above. In other words, the dust core member 13*a* is fixed to the I-shaped core 12 and held in tight contact with the I-shaped core 12. The dust core member 13*a*, which is shaped like a flat plate, configures a dust core 13 serving as a third core.

The dust core 13 (the dust core member 13*a*) is formed by subjecting, to compression molding, dust material, which is powder of, for example, Fe—Al—Si magnetic material having surfaces coated with insulating plastic. The dust core 13 exhibits lower magnetic permeability and higher saturation magnetic flux density than a ferrite core. The thermal conductivity of the dust core 13 is preferably set to 8 to 10 [W/mK], which is higher than the thermal conductivity of plastic such as PET (polyethylene terephthalate).

An E-shaped core 15 serving as a first core is arranged on the surface of the dust core 13 opposite to the adhesion surface adhered to the I-shaped core 12. As a result, the E-shaped core 15, the dust core 13, the I-shaped core 12, and the heat radiation board 11 are arranged sequentially in this order and held in tight contact. As viewed from above, the E-shaped core 15 is oriented in an E shape reversed clockwise at 90 degrees. The E-shaped core 15 is formed of the same material as the I-shaped core 12. That is, the E-shaped core 15 is a ferrite core formed of, for example, a MnZn based material or a NiMn based material.

The E-shaped core 15 includes a substantially plate-like flat portion 15*a*, a pair of pillar-like first leg portions 15*b*, and a pillar-like second leg portion 15*c*. The flat portion 15*a* is shaped identically to each of the cores 12, 13 as viewed from above. The two first leg portions 15*b* extend from opposite ends of the flat portion 15*a* toward the I-shaped core 12. The second leg portion 15*c* extends from the middle of the flat portion 15*a* toward the I-shaped core 12. When the E-shaped core 15 is assembled with the I-shaped core 12 and the dust core 13, the distal surfaces of the first leg portions 15*b* and the second leg portion 15*c* are in contact, or, specifically, tight contact, with the dust core 13. The I-shaped core 12, the dust core 13, and the flat portion 15*a* of the E-shaped core 15 are arranged parallel to one another. The E-shaped core 15 is not fixed to the heat radiation board 11 unlike the I-shaped core 12. The E-shaped core 15 does not contact the heat radiation board 11, which is a heat radiating unit.

A coil 16 is wound around the second leg portion 15*c* of the E-shaped core 15. The coil 16 is a planar coil formed by punching a copper plate in a rectangular frame-like shape. The coil 16 is wound around the second leg portion 15*c* to be parallel to the I-shaped core 12 and the dust core 13. The coil 16 is fixed to a surface, which is a main surface, of a non-illustrated circuit board, for example.

In this manner, the I-shaped core 12, the dust core 13, and the E-shaped core 15 configure a magnetic core 10. On the other hand, the I-shaped core 12, the dust core 13, the E-shaped core 15, and the coil 16 configure a reactor 20 serving as an induction device.

As indicated by arrows Y1 in FIG. 1A, the reactor 20 has a closed magnetic circuit in which a magnetic flux flows from the second leg portion 15*c* to the flat portion 15*a*, the first leg portions 15*b*, the dust core 13, the I-shaped core 12, the dust core 13, and the second leg portion 15*c* or in the opposite direction as the coil 16 receives electric power. Accordingly, each of the leg portions 15*b*, 15*c* functions as a magnetic path forming portion, which is a magnetic leg, for forming a magnetic path by which a magnetic flux proceeds in the direction toward the I-shaped core 12 or the opposite direction, which is the direction away from the I-shaped core 12. The dust core 13 is arranged between the I-shaped core 12 and the E-shaped core 15. More specifically, the dust core 13, which is formed by the single dust core member 13*a*, extends between each of the leg portions 15*b*, 15*c* and the I-shaped core 12.

A method for forming, or manufacturing, the magnetic core 10 and the reactor 20 will hereafter be described.

First, the I-shaped core 12 and the dust core 13 are adhered and fixed to each other. Then, the I-shaped core 12, to which the dust core 13 has been adhered, is adhered and fixed to the heat radiation board 11. Subsequently, the coil 16 is arranged with respect to the I-shaped core 12 and the dust core 13.

Then, by joining the E-shaped core 15 to the I-shaped core 12, the dust core 13, and the coil 16, the magnetic core 10 and the reactor 20 are completed. Specifically, to assemble the E-shaped core 15, the second leg portion 15*c* is passed through the coil 16 while adjusting the positions of the first leg portions 15*b* and the second leg portion 15*c* to prevent the first and second leg portions 15*b*, 15*c* from contacting the coil 16.

Operation of the magnetic core 10 and that of the reactor 20 will now be described.

When the electric current flowing in the coil 16 changes, the magnetic flux in the I-shaped core 12 and the E-shaped core 15 changes, thus causing heat generation in the I-shaped core 12 and the E-shaped core 15. The heat produced by the I-shaped core 12 is transferred from the I-shaped core 12 to the heat radiation board 11, which is in tight contact with the I-shaped core 12, and radiated. In other words, the I-shaped core 12 and the heat radiation board 11 are thermally connected to each other.

In contrast, the E-shaped core 15 does not contact a heat radiating unit such as the heat radiation board 11. This prevents the heat generated by the E-shaped core 15 from being transferred directly to the heat radiating unit, which is the heat radiation board 11, to be radiated, unlike the heat produced by the I-shaped core 12. However, the dust core 13, which is arranged between the I-shaped core 12 and the E-shaped core 15, allows the heat produced by the E-shaped core 15 to transfer to the I-shaped core 12 through the dust core 13 and then to the heat radiation board 11, as indicated by arrows Y2 in FIG. 1A. The heat generated by the E-shaped core 15 is thus easily radiated. In other words, the E-shaped core 15 (the leg portions 15*b*, 15*c*) and the I-shaped core 12 are thermally connected to each other through the dust core 13.

The illustrated embodiment has the advantages described below.

(1) The dust core 13 having lower magnetic permeability than ferrite is arranged between the I-shaped core 12 and the E-shaped core 15 both formed of ferrite. This configuration ensures improved DC superposition characteristics. When the electric current in the coil 16 changes and causes the E-shaped core 15 to generate heat, the heat is transferred to the I-shaped core 12 through the dust core 13 and radiated through the heat radiation board 11. This enhances heat radiation performance, in addition to the improved DC superposition characteristics.

(2) The dust core 13, which is formed by the single flat plate-like dust core member 13*a*, is arranged between each of the leg portions 15*b*, 15*c* and the I-shaped core 12. This configuration decreases the number of the components compared to a configuration in which independent dust cores 13 are arranged for the respective leg portions 15*b*, 15*c*. The magnetic core 10 is thus easily manufactured.

(3) The flat plate-like I-shaped core 12 is fixed to the heat radiation board 11 and the E-shaped core 15 includes the leg portions 15*b*, 15*c*. This facilitates fixation of the core to the heat radiation board 11 compared to a case where the I-shaped core 12 is replaced by an E-shaped core or an L-shaped core having a pillar-like magnetic path forming portion extending toward the E-shaped core 15.

(4) Particularly, in the illustrated embodiment, the I-shaped core 12 fixed to the heat radiation board 11 has a flat plate-like shape. This prevents the position of the coil 16 from being restricted to a specific position due to the core fixed to the heat radiation board 11, unlike a case employing an E-shaped core, for example, instead of the I-shaped core 12. The coil 16 is thus easily installed. Further, the E-shaped core 15, which includes the leg portions 15*b*, 15*c*, is installed after the coil 16 is installed. This facilitates assembly of the E-shaped core 15 without causing contact between the coil 16 and the E-shaped core 15.

(5) The coil 16 is wound around the E-shaped core 15 (the second leg portion 15*c*), which is formed of ferrite having high magnetic permeability, not dust material. This decreases the number of winding by which the coil 16 is wound compared to a case in which the core around which the coil 16 is arranged is formed of the dust material. The magnetic core 10 and the reactor 20 are thus effectively prevented from being enlarged in size.

The present invention is not restricted to the illustrated embodiment but may be embodied in the forms described below.

Figure 2:
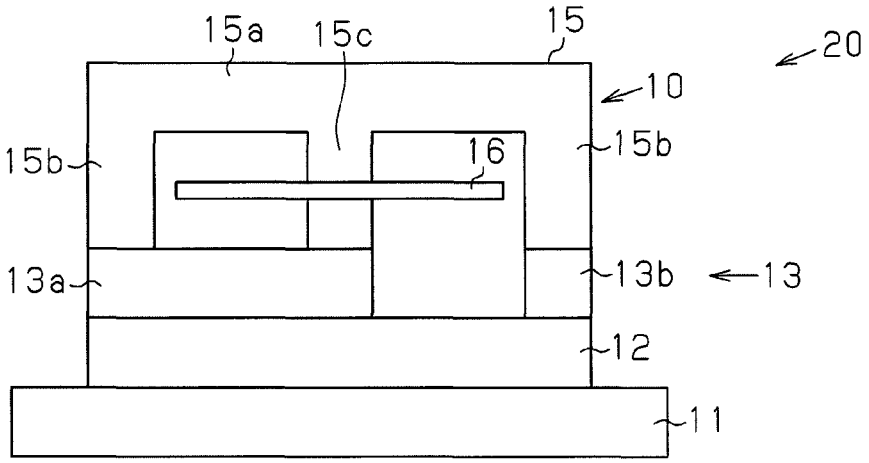
FIG. 2 is a front view schematically showing a magnetic core and a reactor according to another embodiment of the invention.

As illustrated in FIG. 2, the dust core 13 may be configured by a dust core member 13*a* arranged between the second leg portion 15*c* and one of the first leg portions 15*b* (the left leg portion 15*b*) and the I-shaped core 12. In other words, the dust core 13 may be formed by a single member arranged between two or more of the leg portions 15*b*, 15*c* and the I-shaped core 12. In this case, an additional dust core member 13*b* may be deployed between the other one of the first leg portions 15*b* (the right leg portion 15*b*) and the I-shaped core 12. This configuration decreases the number of the components compared to a configuration in which dust core members are employed separately for the respective leg portions 15*b*, 15*c*. As a result, the magnetic core 10 is easily manufactured.

The dust core 13 may be configured by a plurality of dust core members that are arranged separately for the respective leg portions 15*b*, 15*c*. In other words, independent dust cores 13 are deployed for the respective leg portions 15*b*, 15*c*. Each of the dust cores 13 is arranged between the corresponding one of the leg portions 15*b*, 15*c* and the I-shaped core 12.

Figure 3:
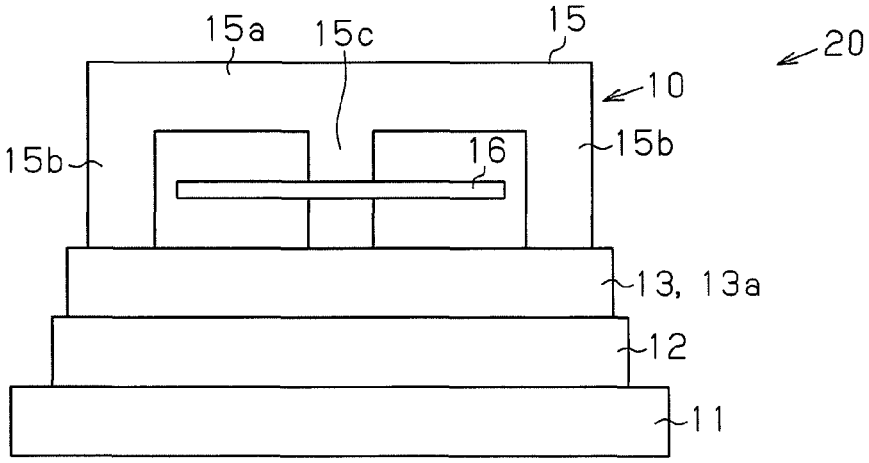
FIG. 3 is a front view schematically showing a magnetic core and a reactor according to another embodiment of the invention.

The I-shaped core 12 and the dust core 13 may be shaped or sized differently from the E-shaped core 15 as viewed from above. For example, as viewed from above in FIG. 3, the dust core 13 may be larger in size than the E-shaped core 15. In this case, the I-shaped core 12 is larger in size than the dust core 13. This configuration prevents any portion of the distal surface of each leg portion 15*b*, 15*c* from becoming spaced from the dust core 13 when the E-shaped core 15 is installed with its position adjusted with respect to the coil 16. Alternatively, the I-shaped core 12 and the dust core 13 may be larger in size than the E-shaped core 15 when the I-shaped core 12 and the dust core 13 are sized and shaped identically to each other, as viewed from above.

The present invention may be used in an electronic device having a plurality of reactors 20 mounted on a heat radiation board 11. For example, to form a specific number of (multiple) reactors 20 with respect to the heat radiation board 11, the specific number of I-shaped cores 12 each having a dust core 13 adhered to the I-shaped core 12 are adhered to the heat radiation board 11. Then, a single circuit board having at least the specific number of coils 16 is arranged such that the coils 16 correspond to the associated I-shaped cores 12 (the associated dust cores 13). Subsequently, the E-shaped cores 15 are mounted sequentially for the respective coils 16 to complete the reactors 20. In this configuration, compared to a configuration in which an E-shaped core is fixed to the heat radiation board 11 instead of the I-shaped core 12, the coils 16 formed on the single circuit board are easily arranged such that the multiple reactors 20 are efficiently formed. Alternatively, some or all of the reactors 20 may each be configured as a transformer having a plurality of coils 16.

The E-shaped core 15 may be modified to a U-shaped core by removing the second leg portion 15*c*. In this case, a coil 16 is wound around each first leg portion 15*b*.

The heat radiation board 11 and the I-shaped core 12, as well as the I-shaped core 12 and the dust core 13, may be fixed together by any suitable method other than adhesion. For example, the E-shaped core 15 may be fixed using a holder that urges the E-shaped core 15 toward the heat radiation board 11.

Instead of the I-shaped core 12, an E-shaped core having three pillar-like magnetic path forming portions that extend toward the E-shaped core 15, a U-shaped core having two magnetic path forming portions, or an L-shaped core having one magnetic path forming portion may be fixed to the heat radiation board 11. In these cases, a flat plate-like I-shaped core without a leg portion or an L-shaped core having one leg portion may be employed instead of the E-shaped core 15. However, to facilitate manufacture of the magnetic core, the configuration of the illustrated embodiment is preferable.

The E-shaped core 15 may be adhered to the heat radiation board 11. In this case, the dust core 13 and the I-shaped core 12 are joined to the E-shaped core 15 sequentially in this order. In other words, the E-shaped core 15 may be caused to radiate heat through the heat radiation board 11.

The coil 16 may be wound around each of the first leg portions 15*b* or the flat portion 15*a* of the E-shaped core 15. Alternatively, the coil 16 may be arranged around the I-shaped core 12 instead of or in addition to the E-shaped core 15.

The I-shaped core 12 may radiate heat through a heat radiating unit other than the heat radiation board 11. For example, by holding the I-shaped core 12 in tight contact with a case accommodating the magnetic core 10 and the reactor 20, the case is allowed to function as the heat radiating unit. Alternatively, refrigerant may be blasted onto the I-shaped core 12.

The I-shaped core 12 and the E-shaped core 15 may be formed by a metal ribbon such as a Si steel plate instead of ferrite. Specifically, a core formed of a metal ribbon exhibits high magnetic permeability than the dust core 13.

The dust core 13 (the dust core member 13*a*) may be formed by subjecting powder of metal glass having surfaces coated with insulating plastic to compression molding.

The magnetic core 10 may be used in a transformer having a plurality of coils 16, which serves as an induction device.

Therefore, the present examples and embodiments are to be considered as illustrative and not restrictive and the invention is not to be limited to the details given herein, but may be modified within the scope and equivalence of the appended claims.

What is claimed is:

1. A magnetic core, comprising:

a first core having a predetermined magnetic permeability, the first core having legs;

a second core of the same material as the first core, the second core providing a closed magnetic circuit together with the first core; and a third core arranged between the first core and the second core, the third core having a lower magnetic permeability than the first core, wherein the first core, the second core and the third core are stacked in a stacking direction, and the second and third cores protrude outwardly beyond the legs of the first core in a direction perpendicular to the stacking direction, the second core is configured to radiate heat through a heat radiator such that the second core contacts the heat radiator, at least one of the first core and the second core being configured to be wound with a coil, the first core has a plurality of magnetic path forming portions, each of the magnetic path forming portions forms a magnetic path in which magnetic flux flows toward or away from the second core, the second core is a single flat plate-like shape and is fixed to the heat radiator, and only the second core contacts the heat radiator, the third core is a single flat plate-like member that contacts all the magnetic path forming portions, the first core, the third core, the second core, and the heat radiator are arranged sequentially in this order and held in tight contact, the second core and the third core contact each other along a single planar surface, and the third core is arranged between all the magnetic path forming portions and the second core.

2. The magnetic core according to claim 1, wherein the third core comprises a powder of a magnetic material subjected to compression molding.

3. An induction device comprising:

a magnetic core; and a coil wound around the magnetic core, wherein the magnetic core includes:

a first core having a predetermined magnetic permeability, the first core having legs; and a second core of the same material as the first core and provides a closed magnetic circuit together with the first core, wherein the second core is configured to radiate heat through a heat radiator such that the second core contacts the heat radiator, at least one of the first core and the second core configured to be wound with the coil, the magnetic core has a third core that is arranged between the first core and the second core and has a lower magnetic permeability than the first core, the first core, the second core and the third core are stacked in a stacking direction, and the second and third cores protrude outwardly beyond the legs of the first core in the stacking direction, the first core has a plurality of magnetic path forming portions, each of the magnetic path forming portions forms a magnetic path in which magnetic flux flows toward or away from the second core, the second core is a single flat plate-like shape and is fixed to the heat radiator, and only the second core contacts the heat radiator, the third core is a single flat plate-like member that contacts all the magnetic path forming portions, the first core, the third core, the second core, and the heat radiator are arranged sequentially in this order and held in tight contact, the second core and the third core contact each other along a single planar surface, and the third core is arranged between all the magnetic path forming portions and the second core.

* * * * *